United States Patent [19]

Vesce et al.

[11] Patent Number: 4,618,813

[45] Date of Patent: Oct. 21, 1986

[54] HIGH EFFICIENCY SERIES REGULATOR

[75] Inventors: Richard V. Vesce, East Hampton; John R. Torres, Somers, both of Conn.

[73] Assignee: United Technologies Corporation, Hartford, Conn.

[21] Appl. No.: 708,197

[22] Filed: Mar. 4, 1985

[51] Int. Cl.[4] ..... G05F 1/445

[52] U.S. Cl. ..... 323/268; 323/278

[58] Field of Search ..... 323/268–269, 323/273, 274, 275, 276, 277, 278, 280, 281, 908; 361/57, 87, 93, 100, 101

[56] References Cited

U.S. PATENT DOCUMENTS

| | | | |
|---|---|---|---|
| 4,180,768 | 12/1979 | Ferraro | 323/278 |
| 4,521,725 | 6/1985 | Phaneuf | 323/285 X |
| 4,536,699 | 8/1985 | Baker | 323/276 |

*Primary Examiner*—Peter S. Wong

*Attorney, Agent, or Firm*—Francis J. Maguire, Jr.

[57] ABSTRACT

A three-terminal series regulator achieves high efficiency by using an enhancement mode P-channel or N-channel FET for the series regulating element, respectively, for positive or negative voltage regulation thereby eliminating the need for a boost voltage and also minimizing the input-to-output voltage differential at high power levels. Short circuit protection is provided using output voltage and current foldback.

3 Claims, 4 Drawing Figures

HIGH EFFICIENCY SERIES REGULATOR

TECHNICAL FIELD

This invention relates to three-terminal linear series regulators, and more particularly to a method and apparatus for providing highly efficient linear regulation at high power levels.

BACKGROUND ART

The power dissipation of any series regulator is equal to the output current times the input-to-output voltage differential which, for monolithic regulators, is on the order of 2–3 volts. For low-voltage supplies this differential results in high inefficiency. When coupled with switching power supplies as a post-regulation stage, the power losses due to the series regulator become disproportionally large and adversely affect the high efficiency one would normally now expect from a switching power supply.

Since the output load current of a regulator is generally fixed by its application requirements, it becomes obvious that to reduce power dissipation and improve efficiency, the input-to-output voltage differential must be minimized. And since present day practice results in a 2 to 3 volt input-to-output differential, a highly undesirable state of affairs exists in the three-terminal regulator art.

In an attempt to improve this situation, Unitrode Corporation has recently introduced a high efficiency series IC regulator which utilizes an external PNP bipolar transister as a series pass element (see *Electronic Design News* (EDN) May 17, 1984, pp. 161–175). Although this configuration is an improvement in reducing the input-to-output voltage differential, considerable base drive power is dissipated due to the bipolar transistor's variable Beta over temperature. Also, any additional load current requires a Darlington configuration which increases the input-to-output voltage differential.

U.S. Pat. No. 3,983,473 issued to Sanderson and U.S. Pat. No. 4,005,353 issued to Yokoyama, both utilize Depletion Mode FET devices to maximize efficiency in a series regulator. However, these designs are restricted to low power circuits since Depletion Mode FETs are low powered devices.

DISCLOSURE OF INVENTION

The object of the present invention is to provide a high efficiency, high-power series regulated power supply with minimum input-to-output voltage differential.

According to the present invention, an Enhancement Mode MOSFET device is utilized in a series regulator as the series regulating element integrated with compatible control circuitry for closed loop regulation and with no boost voltage required. In further accord with the present invention, foldback current limiting is used to limit the power dissipation of the series regulating element.

The series regulator, according to the present invention, provides worst case efficiency on the order of 95%. Gate drive current is negligible resulting in virtually zero gate drive power dissipation. Source-to-drain "on" resistance is low (0.08 to 0.6 ohms) resulting in minimum input-to-output differential voltage drop. The gate-to-source voltage requirements for operation in the linear region result in no boost or auxiliary voltage required to drive the FET. In addition, MOSFETs can be easily paralleled due to the positive temperature coefficient of $R_{on}$ which allows automatic sharing of drain currents. Since devices are presently available in relatively high power ratings (75 & 150 watts) very high efficiencies in high-powered assemblies can be obtained by paralleling the MOSFETs using a minimum number of discrete components.

These and other objects, features and advantages of the present invention will become more apparent in the light of the following detailed description of an exemplary embodiment thereof as illustrated in the accompanying drawing.

BEST MODE FOR CARRYING OUT THE INVENTION

Figure 1:
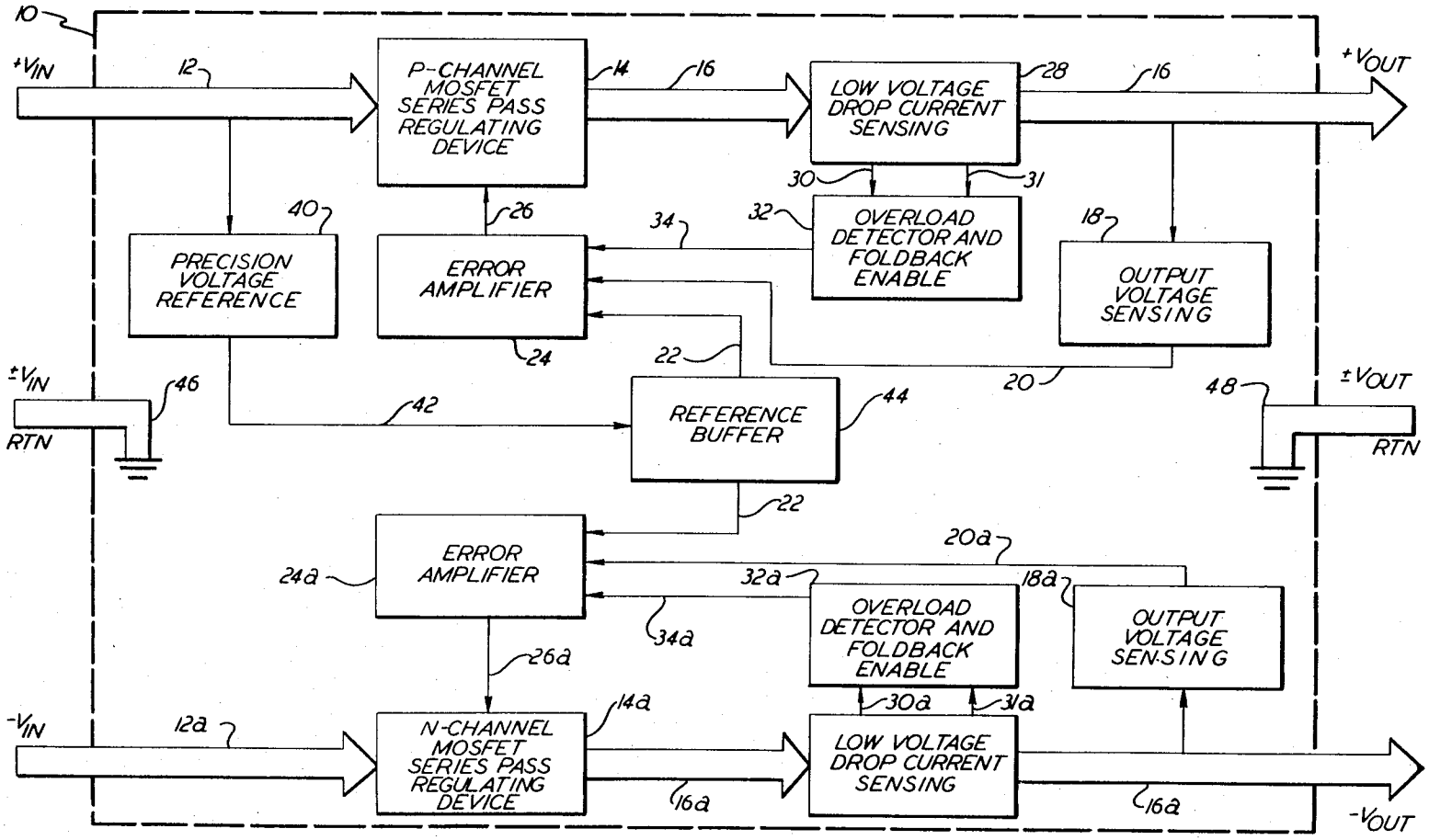
FIG. 1 is a simplified block diagram of both positive and negative series regulators, each according to the present invention.
Figure 3:
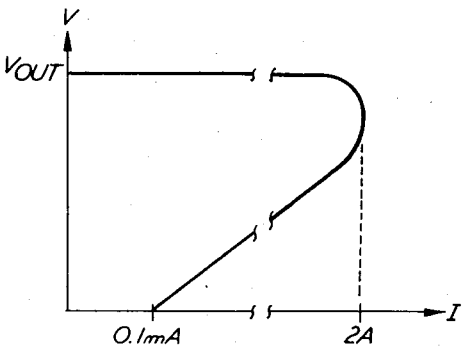
FIG. 3 is an illustration of the "foldback" effect for current limiting a three-terminal MOSFET regulator, according to the present invention.

A simplified block diagram of both a positive and a negative series regulator 10, according to the present invention, is illustrated in FIG. 1. Unregulated positive input voltage ($+V_{IN}$) on a line 12 is controlled by a P-Channel MOSFET series-pass regulating device 14 to maintain a constant output voltage ($+V_{OUT}$) on a line 16 for wide variations of line voltage and load current. The output voltage on the line 16 is continuously monitored in a sensing network 18 which provides a signal on a line 20 which is compared to a voltage reference signal on a line 22 in an error amplifier 24. An error signal on a line 26 is used to control the series-pass regulating device 14. Output current on the line 16 is monitored by a low voltage drop current sensing circuit 28 which provides a pair of sensed signals on lines 30, 31 where they're compared in an overload detector and foldback enable circuit 32 which provides a current foldback signal on a line 34 to the error amplifier 24. The foldback signal acts to lower the reference voltage on the line 22 in the presence of an overload current condition. Output current short circuit foldback is illustrated in FIG. 3 and will be discussed in more detail below.

A precision voltage reference circuit 40 is responsive to the input voltage on the line 12 and provides a precision voltage reference on a line 42 to a reference buffer 44 which in turn provides the reference signal on the line 22 which is provided to both positive and a negative three-terminal series regulator (mirror images of each other in FIG. 1).

The regulator 10 includes a return line 46 on the input side which is illustrated going to "ground" but which should be understood as simply meaning that a return path or common line or node is provided on the card for both internal and external use. Similarly, an output return line 48 is also shown. Both of these nodes are electrically the same although their precise hookup may require special routing to prevent introducing inaccuracies due to lead resistances.

Each of the components in the regulator 10 described thusfar are included within a positive regulating section in the top half of the diagram of FIG. 1. A mirror image of the positive regulator section is also shown in the lower half of FIG. 1. This is a negative regulator having similar components similarly labeled numerically except for a suffix "a" appended thereto. The three-terminal regulator, according to the present invention, refers either to a positive or a negative regulator. Thus, the "three" in three-terminal refers, in a positive regulator, to the positive input and output and ground while in a negative regulator it refers to the negative input and output and ground. The regulator 10 of FIG. 1 shows both a positive and negative regulator because this is the format usually utilized in the art. However, it should be understood that the invention goes to a simple three-terminal regulator rather than the five terminal device shown in FIG. 1.

Figure 2:
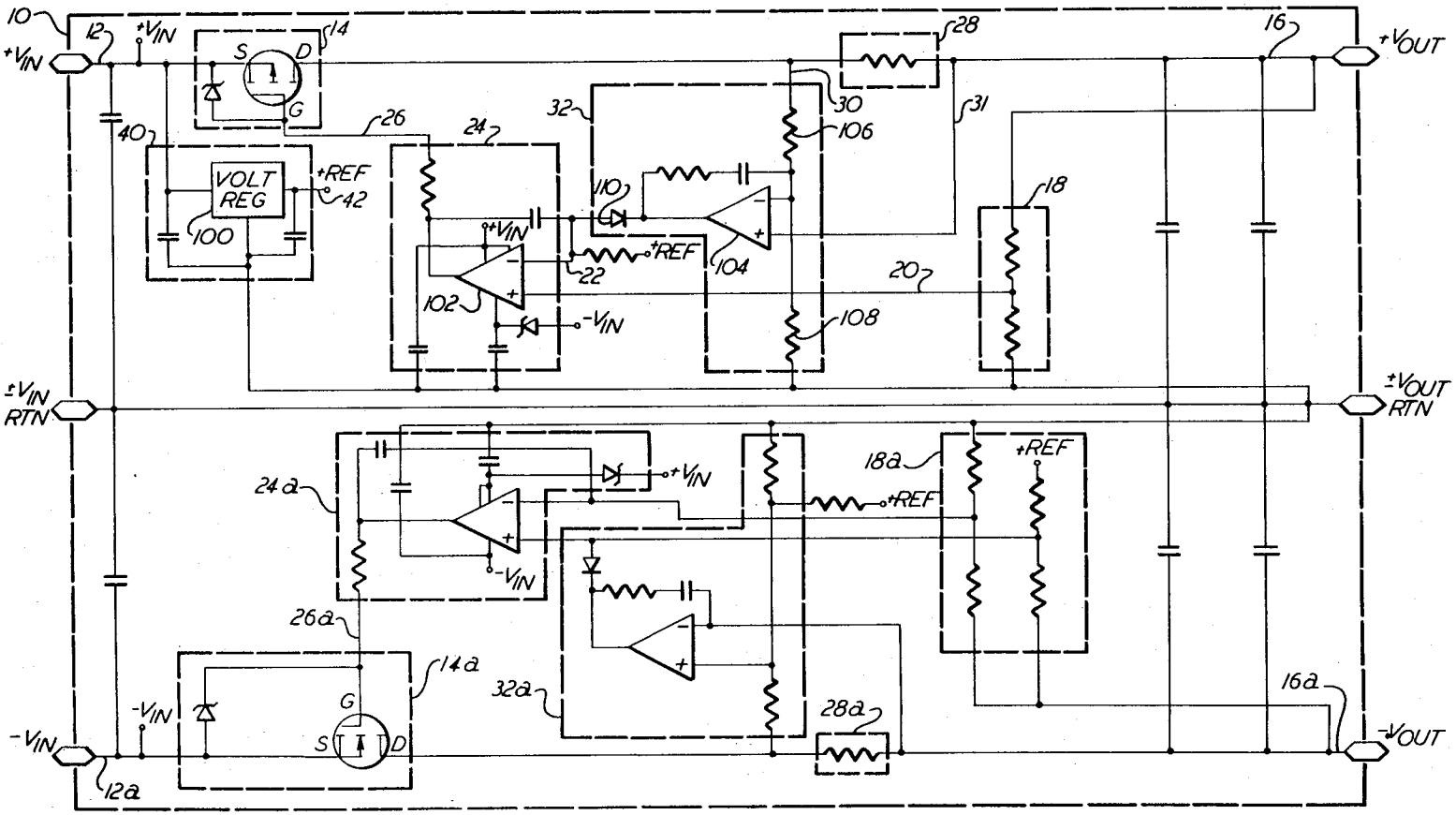
FIG. 2 is a more detailed schematic diagram of the circuitry illustrated in FIG. 1.

FIG. 2 is a more detailed schematic diagram of the regulator 10 of FIG. 1. When positive input voltage ($+V_{IN}$) is applied to the regulator 10 on the line 12, the precision voltage referrence 40 which may include an AD581 voltage regulator 100, is energized and drives the output of the error amplifier 24 (which may comprise one half of a UA747A opamp 102) on the line 26 low, which turns "on" the P-Channel MOSFET device 14. This allows the output voltage on the line 16 to increase until it reaches its designed output level determined bv the output voltage sensing circuit 18 which may include a feedback resistor divider. The ratio of the feedback resistor divider determines the output voltage because the error amplifier will correct its output voltage and regulate the P-Channel FET in its linear region to maintain equal voltages on the opamp's 102 inverting and non-inverting inputs. Since the P-Channel FET requires a gate-to-source voltage between negative 4 and negative 7 volts for linear operation, the error amplifier needs an output swing of only 4 to 7 volts less than $+V_{IN}$. With this simple requirement, the error amplifier needs no B+ boost voltage and is tied directly to $+V_{IN}$.

The output load current is monitored by a low voltage drop current sensing device 28 which may comprise a series resistor developing only 60 to 100 millivolts drop at the overload trip point. This voltage is compared against a 60 millivolt offset voltage applied at the inverting input of an opamp 104 (which may be one half of the UA747A opamp) within the overload detector and foldback enable circuit 32 by a resistor divider 106, 108.

When the output load current exceeds the design trip level, the normally high output of the current sense amplifier 104 switches low and pulls down the reference voltage on the line 22 to the error amplifier 24 through a blocking diode 110 which causes "foldback" of the output voltage and current as shown in FIG. 3. Under a shorted output condition, the voltage at the drain of the P-Channel MOSFET 14 is equal to the voltage drop across the resistive sensing element within the current sensor 28 and therefore the offset voltage on the inverting input of the current sense amplifier 104 decreases to near zero resulting in negligible short circuit current. This provides short circuit protection of indefinite duration with virtually zero power dissipation under a shorted condition.

The operation of the negative regulator is identical to that of the positive regulator except that an N-Channel MOSFET device **14*a* is utilized for the series element because an N-Channel device's active region requires a positive 4 to 7 volt gate-to-source potential which is easily accomplished by the negative error amplifier 24*a*** since its output has to swing only 4 to 7 volts more positive than the negative input rail voltage.

Figure 4:
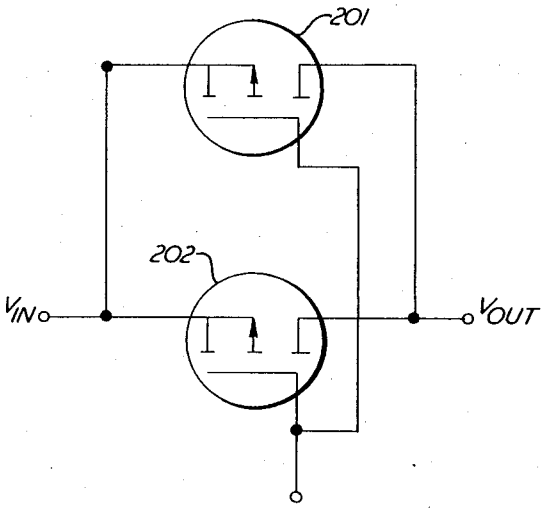
FIG. 4 is an illustration of the manner in which the power handling capabilities of a three-terminal regulator may be increased without decreasing efficiency, according to the present invention.

Ouput current capability can be increased on both the positive and negative outputs by adding MOSFETs in parallel with no drive or circuit changes other than current limit threshold adjustments as shown, for example, in FIG. 4. There, the gates, sources, and drains of two MOSFET devices 201, 202 have been paralled. For maximum efficiency, the total number of FETs required should be determined based on the "$R_{ON}$" rating such that under full load, the maximum input-to-output voltage differential does not exceed one volt under worst case conditions.

Although the invention has been shown and described with respect to illustrated embodiments thereof, it should be understood by those skilled in the art that the foregoing and various other changes, omissions, and additions in the form and detail therof may be made therein without departing from the spirit and the scope of the invention.

We claim:

1. A three-terminal positive voltage series regulator, comprising:

an enhancement mode P-Channel FET series regulating element, responsive at its source node to a positive input voltage source and responsive to a control signal at its gate node for providing a positive regulated output voltage at its drain node;

a reference source, for providing a regulated reference voltage signal;

sensing means, responsive to said regulated output voltage for providing a sensed voltage signal indicative of the present magnitude of said regulated output voltage; and error sensing means, responsive to said reference voltage signal and to said channel voltage signal fro comparing the magnitude of said sensed voltage signal to the magnitude of said reference voltage signal and providing said control signal for regulating said sensed voltage signal at the same magnitude as said reference voltage signal.

2. The regulator of claim 1, further comprising:

output current sensing means, responsive to output current of said series regulating element for providing a sensed current signal having a magnitude indicative of the magnitude of said output current;

overload detector means, responsive to said sensed current signal fro comparing said sensed current signal to a reference signal for providing a foldback enable signal in the presence of a sensed current signal greater than said reference signal, and foldback enable means, responsive to said foldback enable signal for changing the level of said precisely regulated reference source to reduce said output current to a negligible magnitude.

3. A three-terminal negative voltage series regulator, comprising:

an enhancement mode N-channel FET series regulating element, responsive at its source node to a negative input voltage source and responsive to a control signal at its gate node for providing a negative regulated output voltage at its drain node;

a reference source, for providing a regulated reference voltage signal;

sensing means, responsive to said regulated output voltage for providing a sensed voltage signal indicative of the present magnitude of said regulated output voltage; and error sensing means, responsive to said reference voltage signal and to said sensed voltage signal for comparing the magnitude of said sensed voltage signal to the magnitude of said reference voltage signal and providing said control signal for regulating said sensed voltage signal at the same magnitude as said reference voltage signal.

* * * * *

UNITED STATES PATENT AND TRADEMARK OFFICE

CERTIFICATE OF CORRECTION

PATENT NO. : 4,618,813

DATED : 10/21/86

INVENTOR(S) : Richard V. Vesce et al

It is certified that error appears in the above-identified patent and that said Letters Patent is hereby corrected as shown below:

| | |
|---|---|
| Claim 1, column 4, line 42. | Cancel "channel" and substitute -- sensed -- |
| Claim 1, column 4, line 42. | Cancel "fro" and substitute -- for -- |
| Claim 2, column 4, line 54. | Cancel "fro" and substitute -- for -- |

Signed and Sealed this

Twenty-fourth Day of January, 1989

*Attest:*

DONALD J. QUIGG

*Attesting Officer*

*Commissioner of Patents and Trademarks*